United States Patent [19]

Ayer

[11] 3,931,880

[45] Jan. 13, 1976

[54] DOCUMENT HANDLING APPARATUS

[75] Inventor: Thad E. Ayer, Endicott, N.Y.

[73] Assignee: International Business Machines Corporation, Armonk, N.Y.

[22] Filed: May 13, 1974

[21] Appl. No.: 469,132

[52] U.S. Cl. ..... 198/29; 198/76; 271/150; 271/210; 271/221

[51] Int. Cl.[2] ..... B65G 47/22

[58] Field of Search ..... 271/146, 149, 150, 214, 271/215, 221, 210, 162, 164, 168, 169; 198/27, 29, 76, 34

[56] References Cited

UNITED STATES PATENTS

| | | | |
|---|---|---|---|
| 2,739,809 | 3/1956 | Pearce | 271/150 |
| 3,240,489 | 3/1966 | Pinckney et al. | 271/149 |
| 3,348,655 | 10/1967 | Pierce, Jr. et al. | 198/76 |
| 3,374,902 | 3/1968 | Mills | 271/221 |
| 3,452,856 | 7/1969 | Brittain | 198/76 |
| 3,559,984 | 2/1971 | Westra | 271/210 |

*Primary Examiner*—Robert J. Spar
*Assistant Examiner*—James M. Slattery
*Attorney, Agent, or Firm*—Paul M. Brannen

[57] ABSTRACT

Document handling apparatus for use in connection with a demand type of document feed for supplying documents which are operator-fed in bulk, to a demand type of document separator, including apparatus for fluffing and jogging the documents. The fluffing is obtained by a differential increase in the speed of the transport of documents coupled with the use of document stabilizers which are automatically inserted into and retracted from the document stack while the documents are passing through a jogging station which includes apparatus for jogging the documents in two directions.

10 Claims, 6 Drawing Figures

DOCUMENT HANDLING APPARATUS

FIELD OF THE INVENTION

This invention relates generally to document handling apparatus and in particular to an in-line automatic apparatus for fluffing and jogging documents which are loaded in bulk to be fed to a demand type of document feed.

DESCRIPTION OF THE PRIOR ART

The prior art is replete with jogging apparatus in which loads of documents are placed within the apparatus, jogged so that one or two edges are aligned in the bundle, and the bundle thereafter removed. The use of such off-line jogging apparatus requires an extra undesirable step in the handling of documents by an operator.

SUMMARY OF THE INVENTION

It is a principal object of the present invention to provide an improved document handling system incorporating an in-line document jogger.

Another object of the invention is to provide an improved document handling system permitting bulk loading of the system and in-line jogging of the documents.

Still another object of the invention is to provide an improved document handling system in which an in-line jogging station is provided together with document stabilizing means for stabilizing the documents during the jogging.

A further object of the present invention is to provide document handling apparatus including an on-line jogging station utilizing different transport speeds to permit fluffing of the documents to permit jogging.

Still another object of the invention is to provide document handling apparatus including an on-line jogging station having a plurality of stabilizing elements which are automatically inserted in the document stack at the entrance to the jogger, move with the stack and are automatically removed from the stack at the exit of the jogger.

In practicing the invention, a document handling apparatus comprises a bulk document loading area, a jogging station, and a take-away area. The bulk loading area comprises an area in which an operator places a bundle of documents to be processed. Document transport means including a plurality of double-sided timing belts carry the bulk documents to a fluffing and jogging station. At this point a speed change is provided to increase the velocity of the documents to permit fluffing and jogging to be accomplished. Also a plurality of document stabilizers are provided at the fluffing and jogging station, comprising a number of spaced-apart movable blades arranged so that they may be inserted into the document stack, moved forward with the stack at the same speed as the documents upon entering the station, and withdrawn or retracted from the document stack at the exit point of the fluffing and jogging area. A take-away or removal transport means such as a plurality of double-sided timing belts is provided at the take-away area, and the velocity is lower than the document velocity in the jogging area, so that as the documents are removed from the jogging area, they are recompacted, however, with their edges now aligned both horizontally and vertically. The documents are thereafter delivered to a demand type separator station.

The foregoing and other objects, features and advantages of the invention will be apparent from the following more particular description of a preferred embodiment of the invention, as illustrated in the accompanying drawings.

GENERAL DESCRIPTION OF THE DRAWINGS

In the drawings, FIG. 1 is a schematic perspective view of a document handling apparatus illustrating generally a preferred form of the present invention;

Similar reference characters refer to similar parts in each of the different views.

DESCRIPTION OF PREFERRED EMBODIMENT

Figure 1:
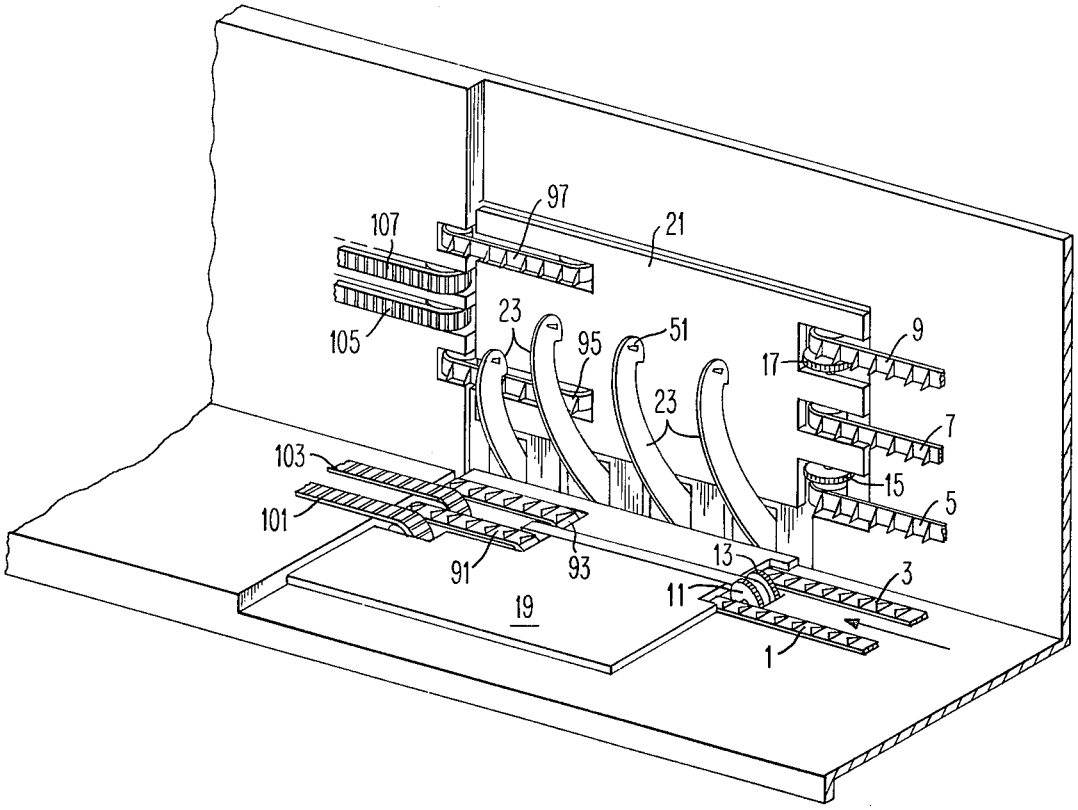

Referring to FIG. 1 of the drawings, a portion of a document handling apparatus incorporating the present invention is illustrated schematically in a perspective type of view. Documents to be fed to the system are loaded in bundles manually by an operator in an operating loading area to the right in the view as shown. The document bundles are placed in an upright position resting on the upper surface of two horizontally running timing belts 1 and 3, provided with teeth on the outer surface thereof as well as on the inside surface where they mesh with the appropriate driving pulleys. The bundles are also in contact with vertically disposed belts 5, 7 and 9, so that the documents are maintained in position both horizontally and vertically by the teeth on the outer surface of the belts. The belts, under the control of document sensing means associated with the demand separator, move from the operator loading area from right to left as seen in the drawing, to the jogging and fluffing area which is at the center portion of the drawing.

At the entrance to the jogging and fluffing area, horizontal fluffing rolls 11 and 13 and vertical fluffing rolls 15 and 17 are provided. These rolls have a serrated outer circumferential surface, and as can be seen from the drawing, are designed to have a periphery which will engage the oncoming documents and raise the documents vertically above the level of the teeth in the timing or transport belts. Also the vertical fluffing rolls 15 and 17 will move the documents in a horizontal direction outwardly from the teeth in the vertically disposed belts 5, 7 and 9. These fluffing rolls may be driven by or mounted on the same shaft on which are mounted the pulleys for engaging the timing belts, so that they are operated in synchronism with the belts except for the fact that the peripheral speed of the rolls is higher than the velocity of the belts. It will be apparent that the fluffing rolls therefore cause the documents not only to be disengaged from the teeth in the horizontal and vertical transport belts, but also since the peripheral speed is higher than the velocity of the belts, the documents will have a higher velocity imparted to them at the entrance of the fluffing area, thereby reducing their compaction to enable the subsequent jogging to be successfully carried out.

In the fluffing and jogging area, a horizontal jogging plate 19 and a vertical jogging plate 21 are provided, arranged to be vibrated at a relatively high frequency in a direction perpendicular to their area. Such vibration acting on the bottom and side edges of the documents will cause the edges of the respective documents to be jogged or vibrated into alignment with each other, so that subsequently, proper feeding of the documents can take place with respect to the aligned bottom and rear edges. The structure of the vibrating plates and mechanism by which they are vibrated will be described hereinafter.

To carry the documents through the fluffing and jogging area, a plurality of document stabilizers or separators 23 are provided, each of which may be described as a thin curved blade of material adapted to be inserted in an arcuate path in the bundle of documents as it is moving through the fluffing and jogging area, to travel with the documents as they move from right to left at the same relative speed as the peripheral speed of the fluffing rolls, and to thereafter be retracted from the document stack at the time the documents are leaving the fluffing and jogging area.

The document stabilizers are carried on chain tracks arranged so that the stabilizers are carried around in an endless loop, and are extended when each of the stabilizers arrives at the entering end of the jogging and fluffing area, and retracted to travel around the return chain path when the stabilizers reach the exit point of the jogging area. Each of the stabilizers is arranged to ride in a carriage which includes rollers that allow the stabilizer to be rotated from a retracted to an extended position, by a suitable actuating means which, at the entrance to the jogging area, contacts a retracted stabilizer and moves it to an extended position, and when the stabilizer reaches the exit area, another actuator contacts the stabilizing element and rotates it to the retracted position to thereafter travel around the return portion of the chain drive.

Figure 2:
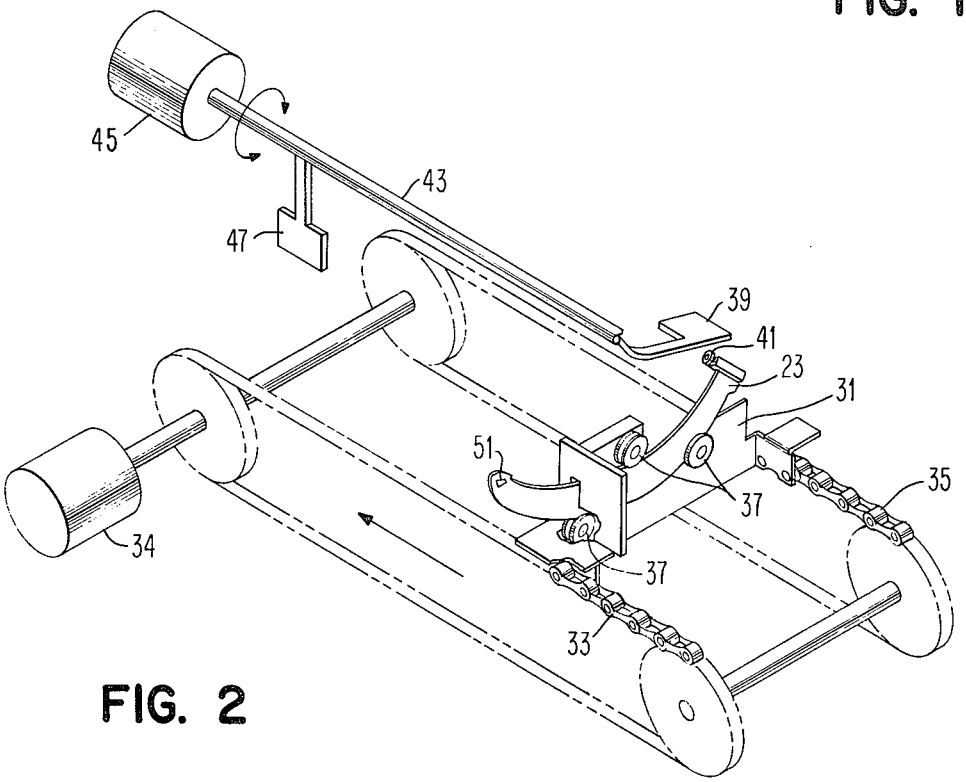
FIG. 2 is a schematic illustration of the arrangement of the document stabilizers employed in the present invention.

Referring to FIG. 2 of the drawings, there is shown, in schematic form, the arrangement of the document stabilizers as described above in connection with FIG. 1. Only one stabilizer element and its associated cart are shown in FIG. 2, for the sake of clarity, but it is understood a plurality of such stabilizer elements and associated carts are provided at equally spaced intervals. The stabilizer element 23 is an arcuate shaped piece of material, such as steel or other suitable metal, carried on a cart 31, which is mounted on endless chains 33 and 35 which are supported by suitable tracks and driven by pulleys arranged to mesh in sprocket fashion with the chains, as can be seen from the drawing. The carts are arranged so that they move at a uniform velocity, which as previously pointed out, is equal to the peripheral speed of the fluffing rolls, so that the document stabilizers maintain the spacing of the documents to permit adequate jogging and to supply support to the documents while the jogging operation is taking place. Each of the carts 31 is equipped with rollers or bearings 37 which engage the edges of the stabilizing element and retain it in place while permitting the element to be rotated into its extended position or to be retracted therefrom. A suitable detent means, not shown in the drawing, is provided to maintain the element in either its inserted or retracted state.

It will be noted that the end of the stabilizing element which is contacted by the insertion arm 39 has a small roller 41 provided thereon, so that the contact between the paddle-shaped end of the insertion arm 39 and the document stabilizer 23 is one of rolling motion to prevent wear of the stabilizing element or the insertion arm.

The insertion actuator or arm is carried on a shaft 43 which is periodically oscillated through an arc by a prime mover 45, which may comprise a motor and crank arrangement or other device for providing precisely timed oscillations to shaft 43. Thus, when one of the stabilizing elements 23 moves by the location of the insertion arm 39, the shaft 43 will oscillate and the surface at the end of the insertion arm will contact the roller 41 on the stabilizing element, and push that end downwardly, which causes the opposite end of the stabilizing element to rotate outwardly and upwardly to thereby be inserted in the documents entering and moving through the jogging station.

At the end of the chain track mechanism at the area of exit from the jogging station, another actuating arm 47 is attached to the shaft 43, and at the time the stabilizer assemblies pass this point, the oscillation of shaft 43 will cause the part 47 to engage the roller 41 on the stabilizing element and thereby cause the stabilizing element to be rotated in a direction so it is retracted from its operative position.

After the stabilizing elements have been retracted at the exit point of the fluffing and jogging area, the recirculating carts pass over the exit end pulleys, and ride back to the entrance point of the jogging area on the underside of the chain track drives, as will be apparent from the drawing.

As can be seen from the drawings, the sprocket wheels or pulleys at the righthand end of the chain track drive assembly are connected together by an idler shaft and revolve in synchronism. The sprocket wheels at the lefthand end of the chain track assembly are connected together on a drive shaft driven by means 34, such as a motor, which is synchronized with the rotation of the fluffing rolls 11 and 13, previously described.

Figure 3B:
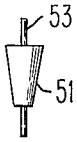
FIGS. 3A and 3B illustrate the tapered rolls used at the end of the document stabilizing elements.
Figure 3A:
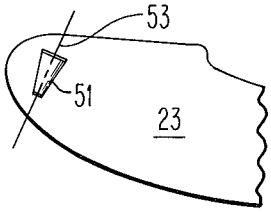

Referring to FIGS. 3A and 3B of the drawings, there is illustrated the tapered rolls located at the end of each of the document stabilizing elements, which enable the stabilizing elements to be inserted in a nonperpendicular deck. This minimizes the possibility of pushing documents out of the mechanism. As shown in FIGS. 3A and 3B, the tapered roll 51 is mounted on a short shaft 53 and arranged for rotation at the end of the document stabilizer in such a way that as the document stabilizer is inserted into the deck and moves upwardly, the documents are contacted by the roller so that the tip friction between the document stabilizer and the documents is reduced sufficiently that the documents are not pushed out of the stack. The document stabilizing roller is tapered as shown and is mounted on a short pin or shaft in an opening at the outer tip of the document stabilizer as can particularly be seen in the sectional view FIG. 3B.

Figure 4:
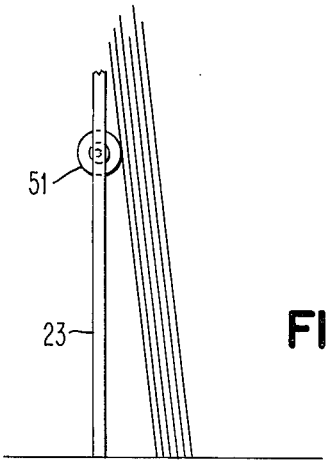
FIG. 4 illustrates the manner in which these tapered rolls operate on the documents.

FIG. 4 shows the relationship between the document stabilizer 23, the tapered roll 51, and the nonvertical stack of documents which are being advanced toward the fluffing station. It will be apparent from the drawing that the stabilizer element will minimize the pushing of documents out of the mechanism since the primary contact of the documents is with the rotatable roller 51 rather than friction against the stabilizer element 23 itself.

Figure 5:
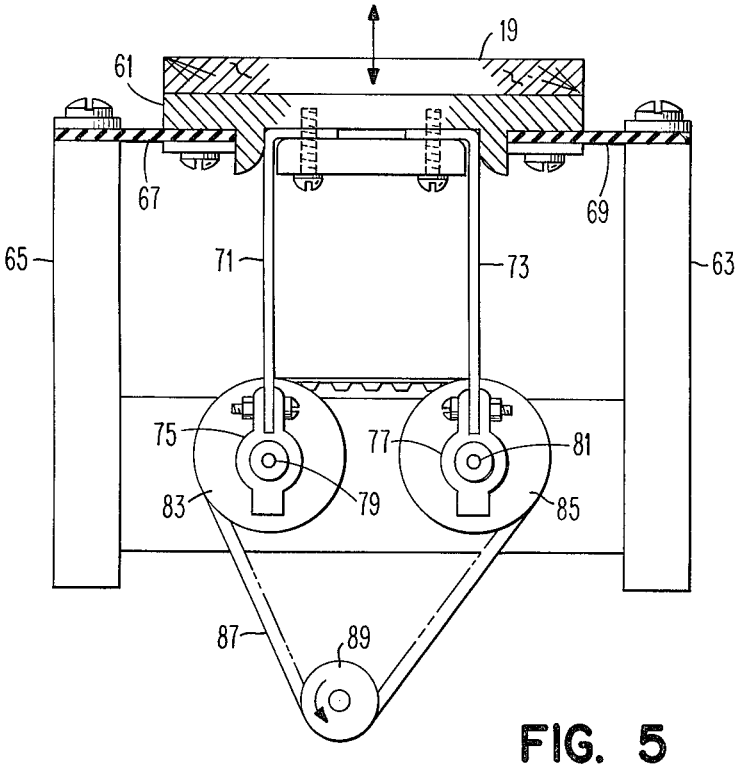
FIG. 5 is a schematic drawing showing the construction of the jogger platform.

FIG. 5 is a schematic illustration of an end view of the horizontal jogger mechanism employed in the present invention. To properly jogger the documents into suitable edge alignment, the jogger plates such as 19 are vibrated at a relatively high frequency in a direction perpendicular to the plane of their surface, as shown in FIG. 5. It is essential that the motion of the jogger plate be restricted to vibrations substantially perpendicular to the plane of the plate surface, and to have relatively little vibration in directions parallel to the plate surface.

Plate 19 is supported by support 61, which in turn is attached to side plates 63 and 65 by suitable elastic flexure members 67 and 69, which may constitute strips of rubber of appropriate dimensions. It will be apparent that this structure will allow the motion of plate 19 in a vertical direction and will not permit any appreciable motion in a horizontal plane. Supoort 61 has attached thereto metal flexure springs 71 and 73, which may be made of steel, for example. These rods are attached to the support 61 at their one end, and have their other ends clamped in eccentric elements 75 and 77, which are arranged for rotation on the shafts 79 and 81. The eccentric elements are designed and arranged so that they provide an oscillation of the connecting flexure springs 71 and 73 through a given amplitude when the shafts 79 and 81 are rotated. Rotation of these shafts may be obtained by the use of pulleys 83 and 85, together with a timing belt 87 connecting the pulleys 83 and 85 with a drive pulley 89. It will be apparent that rotation of the drive pulley 89 will cause similar rotation of the pulleys 83 and 85 and the shafts 79 and 71, whereby the eccentric elements 75 and 77 are orbited and transmit their motion through the connecting elements 71 and 73 to the support 61, thereby causing oscillation of jogger plate 19. Since a timing belt connects pulleys 83 and 85, their rotation will be maintained in phase to provide in-phase operation of elements 71 and 73.

One such pair of eccentrics and connecting elements is provided at each end of the motion plate 19 to thereby provide uniform vibratory motion to the plate.

A second jogging mechanism similar to that shown in FIG. 5 is also provided for the vertical jogger plate 21, the parts being aligned at 90° to the arrangement shown in FIG. 5 as required by the layout of the mechanism.

Returning now to FIG. 1, at the lefthand or exit end of the fluffing and jogging area, the stabilizer elements 23 are withdrawn at the exit end of the jogging area, and at this point the exiting documents are moved by sets of vertical and horizontal exit belts 91, 93, and 95 and 97, respectively. These move at the same peripheral speed as that of the fluffing rolls.

These belts then deliver the jogged documents to the separator area feed belts including horizontal belts 101 and 103 and vertical belts 105 and 107. The separator feed belts run at a speed slightly faster than the belts 1, 3, 5, 7 and 9 which deliver the documents to the fluffing area, but slower than the delivery belts 91, 93, 95, 97, so that the documents are again compacted and sent onward to the separator area to the left of the jogging and fluffing station as shown in FIG. 1.

The entire assembly as seen in the view of FIG. 1 is tilted somewhat from the vertical, so that the documents have a tendency to remain in place resting against the transport belts, instead of falling forwardly and out of the transport area. It is apparent from the foregoing that the present invention provides an improved document transport system in which an in-line jogging and fluffing station is provided, which provides for in-line jogging of batches of documents which are bulk loaded into the document transport. Such an arrangement is advantageous in that it reduces the number of times that a batch of documents must be handled prior to machine processing. The fluffing is accomplished by document stabilizing elements which are arranged to be inserted and retracted from the documents as they move through a jogging station comprising vibrating platforms operating in orthogonal planes.

While the invention has been particularly shown and described with reference to a preferred embodiment thereof, it will be understood by those skilled in the art that various changes in form and details may be made therein without departing from the spirit and scope of the invention.

I claim:

1. Document handling apparatus comprising a first plurality of endless belts moving in synchronism and with a first velocity upon which the documents are loaded in bulk and are disposed substantially vertical, fluffing means to which the documents are delivered by said belts for accelerating the documents to a second velocity greater than said first velocity to thereby decompact the documents, a plurality of separate document stabilizing blades insertable one at a time between groups of said documents for stabilizing the motion of said decompacted documents, moving with said documents at said second velocity, and removable one at a time from between said groups of documents, actuating means for cyclically inserting and removing said stabilizing elements from said documents, jogging means for jogging said documents to align at least one edge of the documents, while being stabilized by said stabilizing elements, and a second plurality of endless belts moving in synchronism and with said first velocity for receiving and recompacting the jogged documents.

2. Document handling apparatus as claimed in claim 1, further characterized by said fluffing means comprising a plurality of rolls operating in synchronism with said first plurality of belts, and provided with a serrated periphery having a peripheral velocity greater than said first velocity, said rolls being positioned to receive the documents from said first plurality of belts and deliver them to said jogging means.

3. Document handling apparatus as claimed in claim 1, further characterized by said document stabilizer elements comprising a plurality of retractable blades spaced apart and moving at said second velocity, and activating means for inserting the blades into the stack of documents at the location of said fluffing means and for retracting said blades at the exit from said jogging means.

4. Document handling apparatus as claimed in claim 1, further characterized by said jogging means comprising a horizontal and a vertical jogging plate, and vibrating means for vibrating said plates in a direction perpendicular to the plane of their surface.

5. Document handling apparatus as claimed in claim 1, further characterized by said stabilizing elements having roller means mounted thereon for engagement with the documents when said stabilizers are inserted in the document stack.

6. Document handling apparatus as claimed in claim 1, further characterized by having a plurality of cart means, one for each of said stabilizer elements, and endless chain belt means to which said cart means are attached, for transport of said stabilizer elements from the location of said fluffing means to the exit of said jogger means, said stabilizer elements being mounted on said carts for movement from a retracted position to an extended position where the stabilizing elements are inserted in the document stack.

7. Document handling apparatus comprising, in combination a first belt conveyor for conveying compacted documents loaded in bulk on said conveyor at an operator station, with a first velocity, a fluffing and jogging station to which said bulk documents are delivered by said first belt conveyor, fluffing means located at said station for accelerating said documents individually or in small numbers from said first velocity to a second velocity higher than said first velocity, jogging means located at said station for vibrating said documents to align at least one edge of the documents, document stabilizing means located at said station and movable at said second velocity for moving the documents past said jogging means, and a second belt conveyor for conveying said documents away from said station at said first velocity.

8. Document handling apparatus as claimed in claim 7, further characterized by said fluffing means comprising a plurality of horizontal and vertical fluffing rolls having serrated peripheries with a peripheral velocity equal to said second velocity for engaging said documents and accelerating them to said second velocity.

9. Document handling apparatus as claimed in claim 7, further characterized by said document stabilizing means comprising a plurality of stabilizer blades, a corresponding plurality of carts one for each of said stabilizer blades, first and second endless chain belts arranged to ride in synchronism on drive and idler pulleys, driving means connected to said belts for driving said belts, said carts being attached to said belts to move around a closed path having at least one portion adjacent said jogging means, and said blades being movably attached to said carts, and actuating means cyclically movable to extend and retract said stabilizer blades.

10. Document handling apparatus as claimed in claim 9, further characterized by said stabilizer blades each having an anti-friction roller at the end of the blade which contacts the documents.

* * * * *